US008813317B2

(12) United States Patent
Mitchell, Jr. et al.

(10) Patent No.: US 8,813,317 B2
(45) Date of Patent: Aug. 26, 2014

(54) STRAP LATCHING DEVICE

(75) Inventors: Bruce James Mitchell, Jr., Dexter, MI (US); Joseph Albert Simon, Ann Arbor, MI (US)

(73) Assignee: Home Team Sports, LLC., Ann Arbor, MI (US)

( * ) Notice: Subject to any disclaimer, the term of this patent is extended or adjusted under 35 U.S.C. 154(b) by 315 days.

(21) Appl. No.: 13/292,974

(22) Filed: Nov. 9, 2011

(65) Prior Publication Data

US 2012/0144628 A1 Jun. 14, 2012

Related U.S. Application Data

(60) Provisional application No. 61/411,716, filed on Nov. 9, 2010.

(51) Int. Cl.
*A44B 17/00* (2006.01)
*A44B 11/02* (2006.01)
*A42B 3/08* (2006.01)

(52) U.S. Cl.
CPC ..... *A42B 3/08* (2013.01)
USPC ..... 24/324; 24/633; 24/651

(58) Field of Classification Search
CPC ..... A42B 3/08; A44B 11/02
USPC ..... 24/163 R, 164–174, 191, 322.1, 323, 24/324, 633, 651
See application file for complete search history.

(56) References Cited

U.S. PATENT DOCUMENTS

| | | | | | |
|---|---|---|---|---|---|
| 1,871,378 | A * | 8/1932 | Kimbell | 24/324 |
| 1,902,557 | A * | 3/1933 | Janes | 24/324 |
| 1,904,055 | A * | 4/1933 | King | 24/324 |
| 2,039,110 | A * | 4/1936 | Patchen | 24/324 |
| 2,486,652 | A * | 11/1949 | Huelster | 24/324 |
| 3,237,257 | A * | 3/1966 | Forsberg | 24/324 |
| 5,259,096 | A * | 11/1993 | Grant | 24/324 |
| 6,481,066 | B1 * | 11/2002 | Ide et al. | 24/324 |
| D486,093 | S * | 2/2004 | Tobergte | D11/218 |
| 7,475,453 | B2 * | 1/2009 | Drake et al. | 24/324 |
| D623,088 | S * | 9/2010 | Schiebl | D11/220 |
| D628,515 | S * | 12/2010 | Schiebl | D11/218 |
| 8,056,151 | B2 * | 11/2011 | Bologna et al. | 2/421 |
| 2007/0193006 | A1 * | 8/2007 | Kitano et al. | 24/323 |

* cited by examiner

*Primary Examiner* — Robert J Sandy
*Assistant Examiner* — Louis Mercado
(74) *Attorney, Agent, or Firm* — Vivacqua Law, PLLC; Raymond J. Vivacqua

(57) ABSTRACT

A latching device secures a strap to a piece of sports equipment. The latching device includes a buckle and a base. The buckle has a main body portion. The main body portion has an integrally formed collet and has a first slot and a second slot. The first and second slots each having a plurality of teeth shaped members that are configured to secure the strap to the buckle. The base is attached to the piece of sports equipment. The base has a first shaft and an annular ring. The first shaft has a first end and a second end. A ball shaped member is attached to the first end of the first shaft. The annular ring is formed on a periphery of the base surrounding the first shaft. The ball shaped member is releasably received in the collet to releasably engage the buckle with the base.

19 Claims, 11 Drawing Sheets

STRAP LATCHING DEVICE

FIELD

The present invention relates to athletic equipment and other equipment or devices that utilize straps or bands to retain equipment or devices on an athlete and more particularly to devices for realeasably attaching straps and other members to the equipment to retain the equipment on an athlete.

BACKGROUND

Sports helmets, particularly football helmets, have undergone substantial changes over the last 50 years. Helmets are retained by a chinstrap laced through buckles that snap onto the helmet. The buckles integrate ordinary snaps similar to snaps on a jacket. The chinstrap fixes the helmet in position and is designed to retain the helmet on a player's head. Current chinstrap buckles become unsnapped during game play on impact or by other game circumstances, resulting in helmets coming off during play. As sports such as football have become higher velocity contests, helmets are coming off at increasing and alarming rates causing potential danger to participants.

Youth players often lack sufficient strength to properly snap current buckles. This results in incomplete engagement and uncertain stability and retention. Youth players are also often unsure when current buckles are actually properly engaged as a definitive "snap" is often unattainable.

SUMMARY

In an embodiment of the present invention a latching device for securing a strap to a piece of sports equipment is provided. The latching device includes a buckle and a base. The buckle has a main body portion. The main body portion has an integrally formed collet and has a first slot and a second slot. The first and second slots each having a plurality of teeth shaped members that are configured to secure the strap to the buckle. The base is attached to the piece of sports equipment. The base has a first shaft and an annular ring. The first shaft has a first end and a second end. A ball shaped member is attached to the first end of the first shaft. The annular ring is formed on a periphery of the base surrounding the first shaft. The ball shaped member is releasably received in the collet to releasably engage the buckle with the base.

In yet another embodiment of the present invention, the buckle further comprises a retention member fixedly secured to the main body portion. The retention member has a collet cavity. The collet is disposed in the collet cavity.

In yet another embodiment of the present invention, the collet cavity has a first open end and a second open end and a bowl shaped interior surface extending between the first and second open ends.

In yet another embodiment of the present invention, the base has a first surface and a second surface, and the second end of the first shaft is fixed to the first surface of the base.

In yet another embodiment of the present invention, the first shaft has a threaded end in threaded engagement with a threaded aperture in the first surface of the base.

In yet another embodiment of the present invention, the base further comprises a second threaded shaft extending from the second surface of the base, and the second threaded shaft is disposed through an aperture in the piece of sports equipment and a threaded fastener engages the threaded shaft to secure the base to the piece of sports equipment.

In still another embodiment of the present invention, the collet has four collet fingers and each of the collet fingers have a first end attached to the base and a second end that is configured to engage the ball shaped member.

In still another embodiment of the present invention, each of the four collet fingers have a chamfered surface that engages the ball shaped member of the base.

In still another embodiment of the present invention, the first end of each of the collet fingers are attached to the base by a living hinge made of a polymeric material.

In still another embodiment of the present invention, a latching device for securing a strap to a piece of sports equipment is provided. The latching device includes a buckle, a biasing member and a locking ball assembly. The buckle has a main body portion, a collet member and a retention member. The collet member has an integrally formed collet. The retention member is fixedly secured to the main body portion. The retention member has a collet cavity. The collet cavity has a first open end and a second open end. The collet member is moveably disposed between the main body portion and the retention member. The biasing member is disposed between the main body portion and the collet member. The biasing member provides a biasing force to urge the collet member away from the main body portion and force the collet into the first open end of the collet cavity. The locking ball assembly is attached to the piece of sports equipment. The locking ball assembly has a first threaded shaft having a first end and a second end. A ball shaped member is formed on a first end of the threaded shaft and the second end has a threaded portion. The base has a first surface and a second surface. The first surface has a threaded aperture for receiving the threaded portion of the first threaded shaft and an annular ring formed on a periphery of the base and a second threaded shaft extending from the second surface of the base. The ball shaped member is releasably received in the second open end of the collet cavity and the collet to releasably engage the buckle with the locking ball assembly.

DRAWINGS

The drawings described herein are for illustration purposes only and are not intended to limit the scope of the present disclosure in any way.

DETAILED DESCRIPTION

Figure 1:
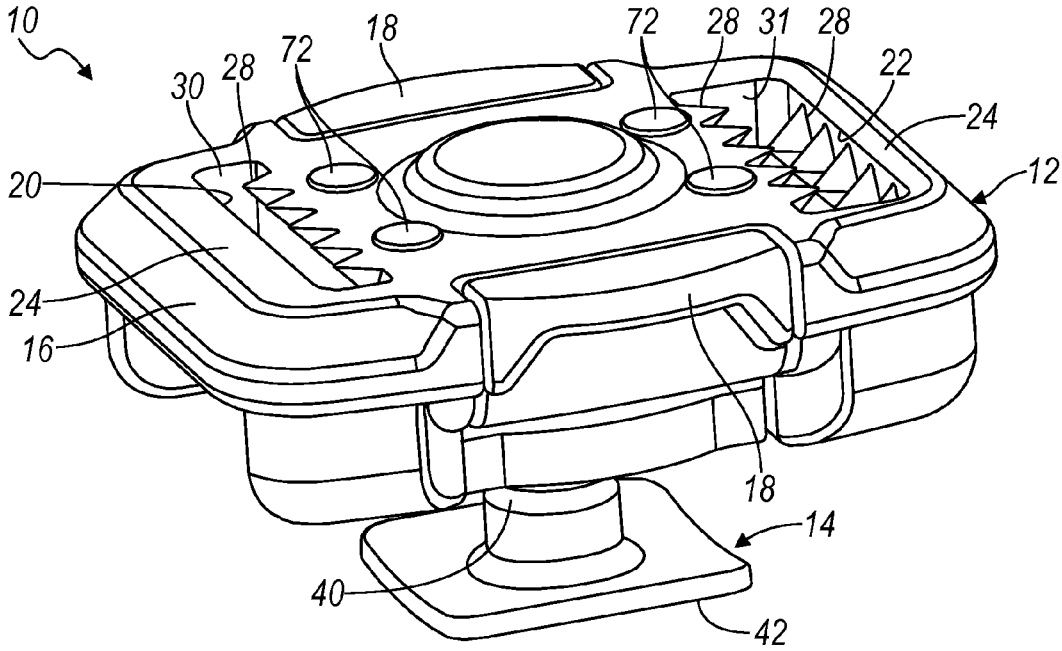
FIG. 1 is a perspective view of a top side of a strap latching device in accordance with the present invention.
Figure 2:
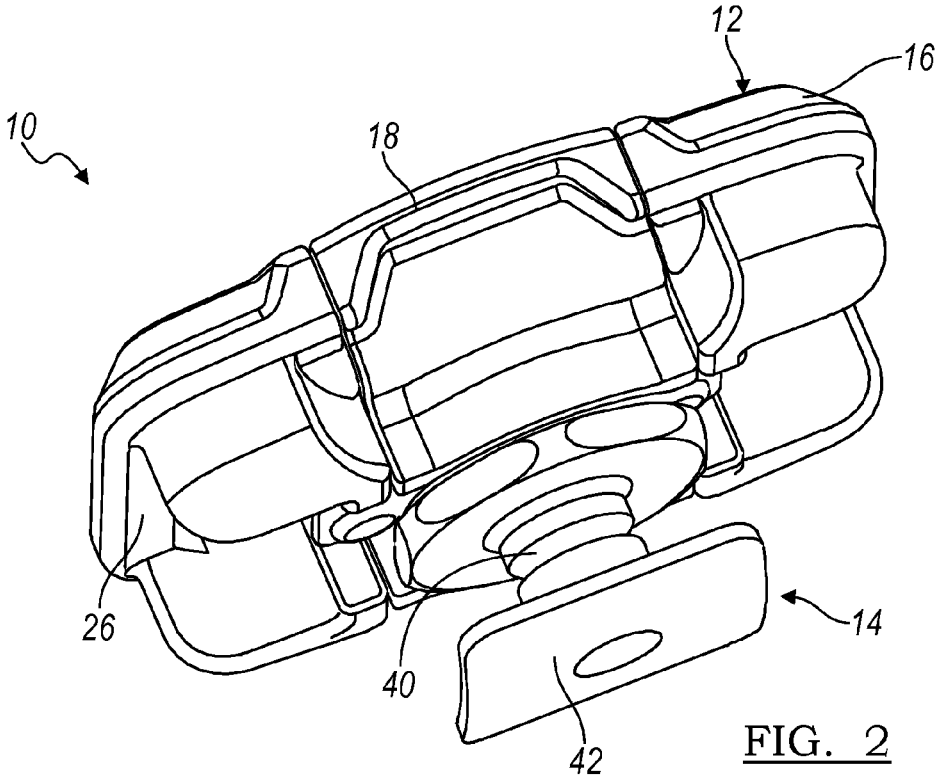
FIG. 2 is a perspective view of a bottom side of a strap latching device in accordance with the present invention.

Referring now to FIGS. 1, 2, 3, 4 and 4A a strap latching device 10 is illustrated in accordance with the present invention. Strap latching device 10 is configured to releaseably secure a strap or band to a piece of sports or safety equipment such as a football helmet, safety helmet or other protective device. An exemplary safety helmet is shown in U.S. Pat. No. 7,900,279,hereby incorporated by reference.

Strap latching device 10 includes a locking buckle 12 and a locking ball assembly 14. Locking buckle 12 includes a main body portion 16 generally rectangular in shape and a release mechanism 18. Main body portion 16 has a pair of rectangular slots 20 and 22 that extend transversely across a top surface 24 of the main body 16 and extend through to a bottom surface 26. Slots 20 and 22 include a plurality of retention teeth 28 disposed along interior walls 30 and 32, respectively, of slots 20, 22. Locking ball assembly 14 has a generally spherical ball member 32 disposed on the end of a shaft 34. Shaft 34 extends from a base surface 36. In an embodiment of the present invention, shaft 34 is threaded into an aperture in base surface 36. Thus, the distance spherical ball member 32 is from the base surface 36 may be adjusted. Base surface 36 is surrounded by a raised annular ring 38. The locking ball assembly 14 further includes a threaded shaft 40 and a retention nut 42. The threaded shaft 40 is insertable through a clearance hole (not shown) in a helmet or other safety equipment and is fastened to the equipment through threaded engagement with a threaded bore in the retention nut 42.

Figure 3:
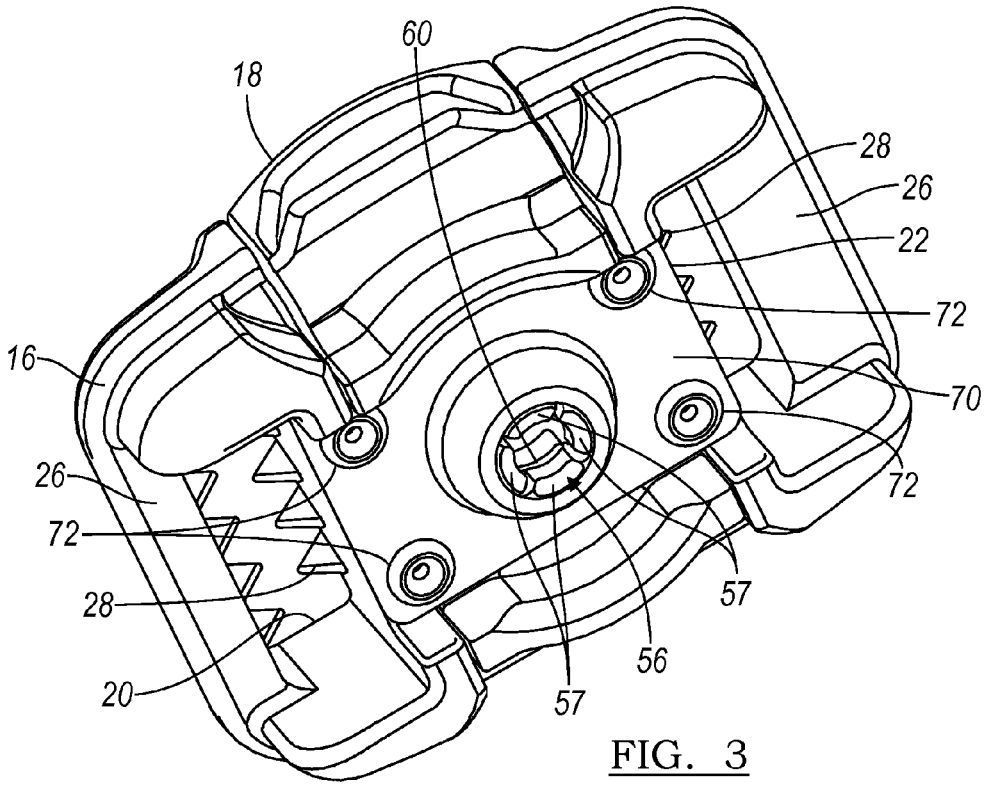
FIG. 3 is a perspective view of a locking buckle and a retention plate of the strap latching device in accordance with the present invention.
Figure 4:
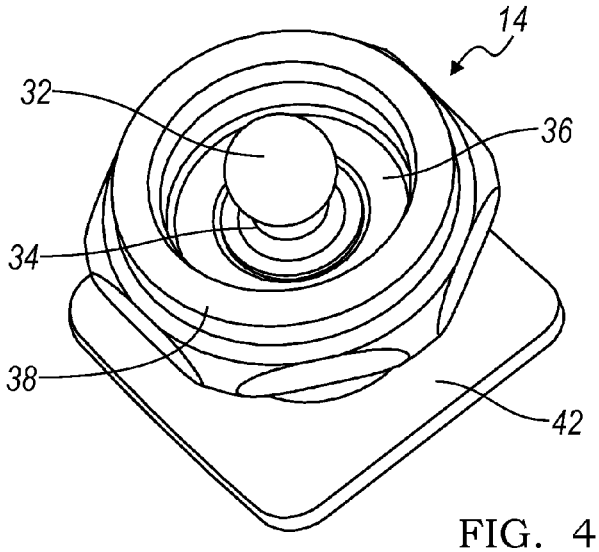
FIG. 4 is a perspective view of a locking ball assembly of the strap latching device in accordance with the present invention.
Figure 4A:
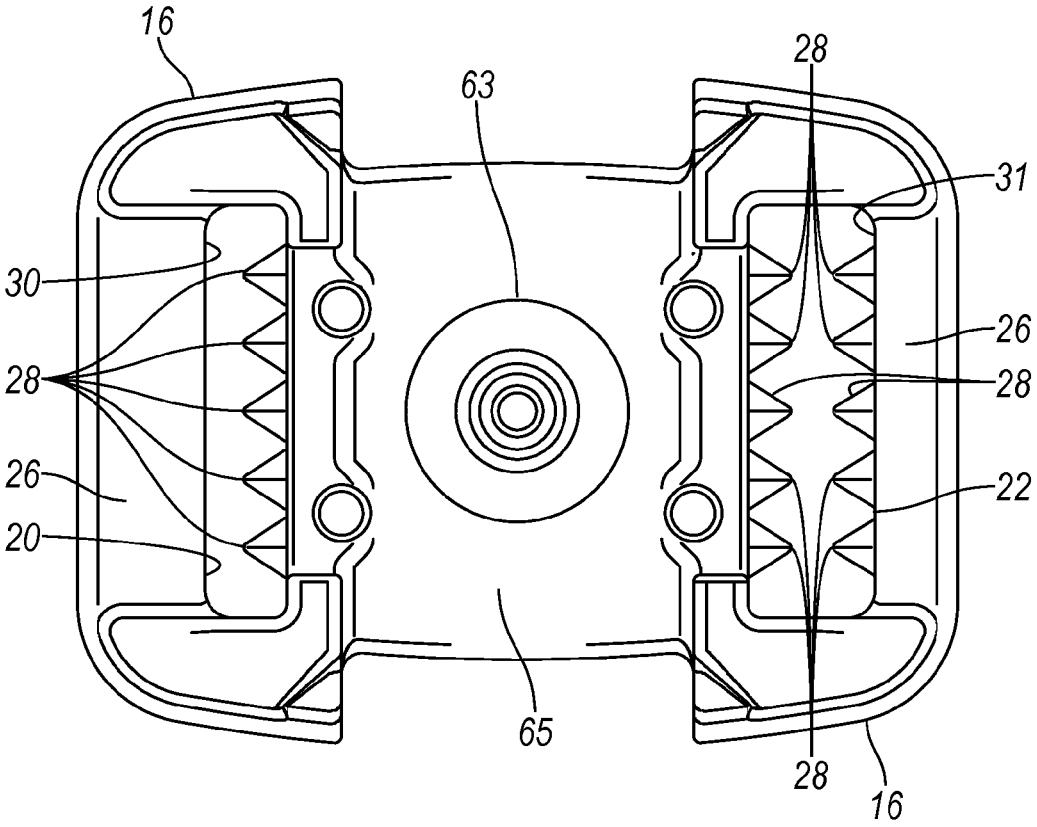
FIG. 4A is a bottom view of a main body portion of the locking buckle of the strap latching device in accordance with the present invention.

With continuing reference to FIG. 3 and also with reference to FIGS. 5 through 8, the release mechanism 18 is further illustrated in accordance with the present invention. Release mechanism 18 includes a generally planar base portion 50 and an opposing pair of wing portions 52 and 54. Wing portions 52 and 54 extend from base portion 50 and fit within U-shaped channels in the main body portion 16 of locking buckle 12. Generally, centered in the base portion 50 is a collet 56. Collet 56 is formed integral with the base portion 50 and includes four collet fingers 57. The collet 56 is configured to capture the locking ball 32. Each of the four collet fingers 57 have a first end 58 that are pivotally connected to the base portion 50 by means of a living hinge. Moreover, each of the four collet fingers 57 have a second end 59 that has a locking ball reaction surface 60. Locking ball reaction surface 60 is an angled or chamfered surface that interacts with the locking ball 32, as will be described herein below. While four collet fingers 57 are described and illustrated the present invention contemplates that fewer or more than four collet fingers may be employed. Release mechanism 18 further includes a coil spring 62 that has a first end 64 that contacts planar base portion 50. Coil spring 62 is generally concentric with collet 56. The coil spring 62 is kept in a predetermined position in the locking buckle 12 by a recessed area and post 63 formed in a surface 65 of the main body portion 16 and by a recessed pocket formed in release mechanism 18. Additionally, coil spring 62 has a second end 66 that contacts and exerts a force on the main body portion 16.

Figure 5:
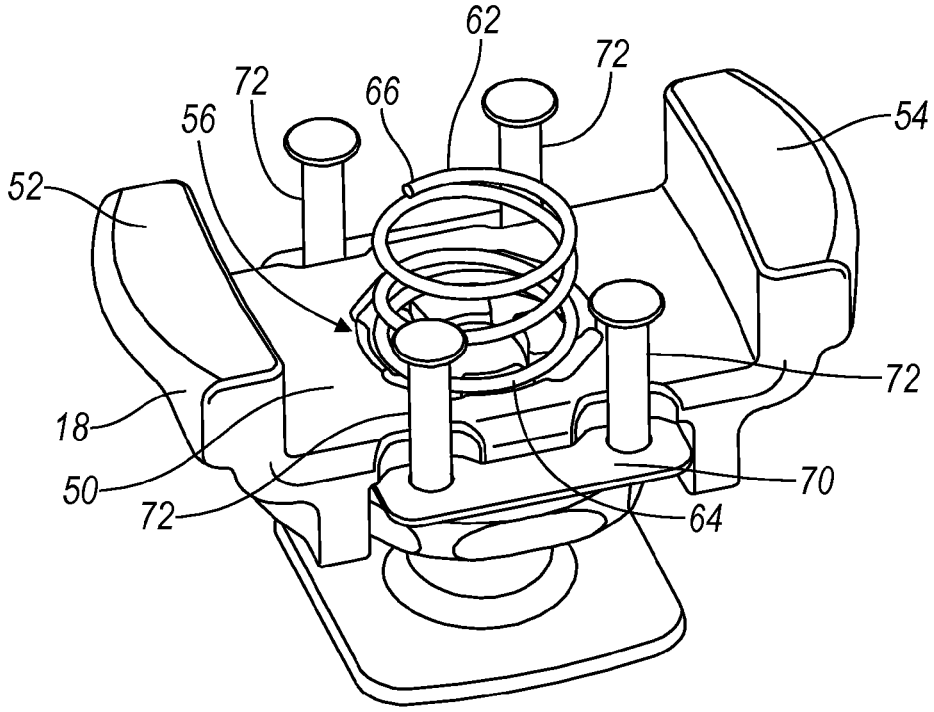
FIG. 5 is a perspective view of a release mechanism of the locking buckle of the strap latching device in accordance with the present invention.
Figure 6:
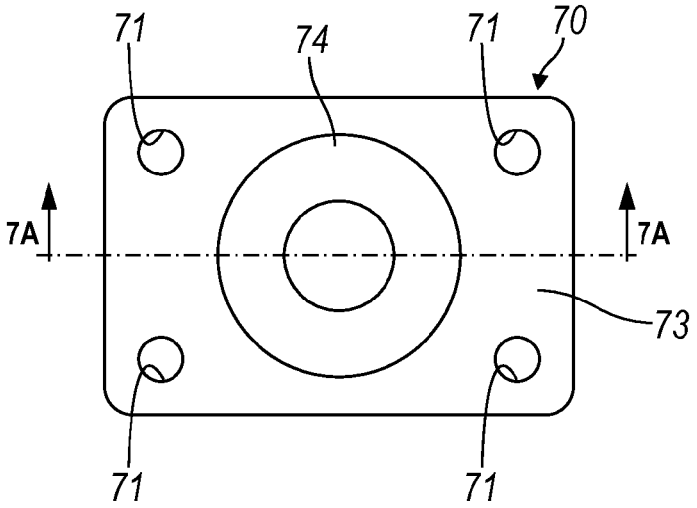
FIG. 6 is a top surface view of the retention plate of the locking buckle of the strap latching device in accordance with the present invention.
Figure 7A:
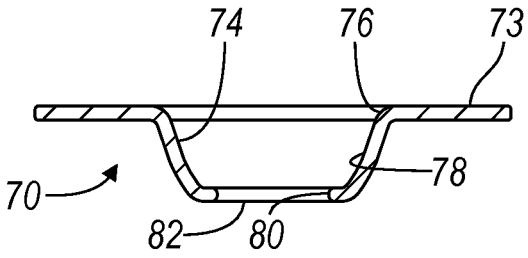
FIG. 7A is a cross-sectional view of the retention plate of the locking buckle of the strap latching device in accordance with the present invention.
Figure 7B:
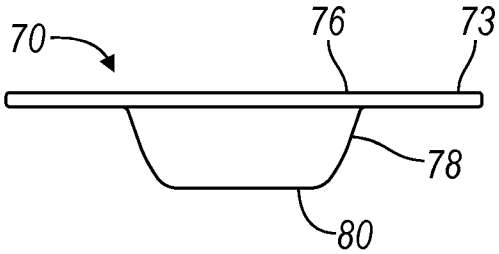
FIG. 7B is a side view of the retention plate of the locking buckle of the strap latching device in accordance with the present invention.
Figure 8:
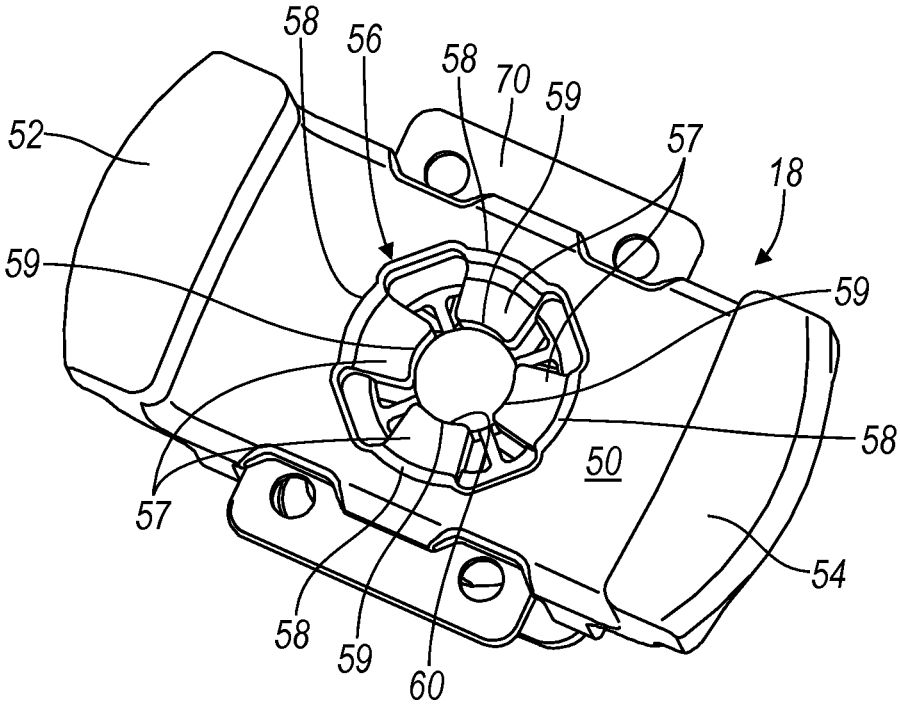
FIG. 8 is a top view of the release mechanism and retention plate of the locking buckle of the strap latching device in accordance with the present invention.

With specific reference to FIGS. 6, 7A and 7B, plan, cross-sectional and side views of a retention plate 70 are illustrated. Retention plate 70 along with a plurality of fasteners 72 (as shown in FIG. 5), such as rivets or the like, capture the release mechanism 18 within the main body portion 16. More specifically retention plate 70 has, for example, four apertures 71 through which the rivets or fasteners are through to attach plate 70 to main body portion 16. Further, a retention plate 70 has a generally planar surface 73 and a cavity 74 centered in the surface 73. In an embodiment of the present invention cavity 74 is shaped like a bowl having a first open end 76, a curved side wall 78 and second open end 80. However, the present invention contemplates that cavity 74 has other shapes in alternate embodiments of the invention. For example, cavity 74 has a cylindrical wall adjacent second open end 80 and a curved wall adjacent first open end 76. In operation, the spring 62 presses the release mechanism 18 and as a result the collet fingers 57 against the curved sidewall 78 of the chamber plate 70 keeping the collet fingers 57 in a locked position in the chamber plate 70. The raised annular ring 38 of the locking ball assembly 14 is configured to guide curved sidewall 78 to ensure alignment of the locking ball 32 with the second open end 80 and the collet 57. Additionally, the raised annular rim 38 stabilizes the locking buckle 12. Advantageously, the raised annular rim 38, locking ball 32 and shaft 34 are sized to reduce the distance the locking ball extends past the annular rim.

Figure 9:
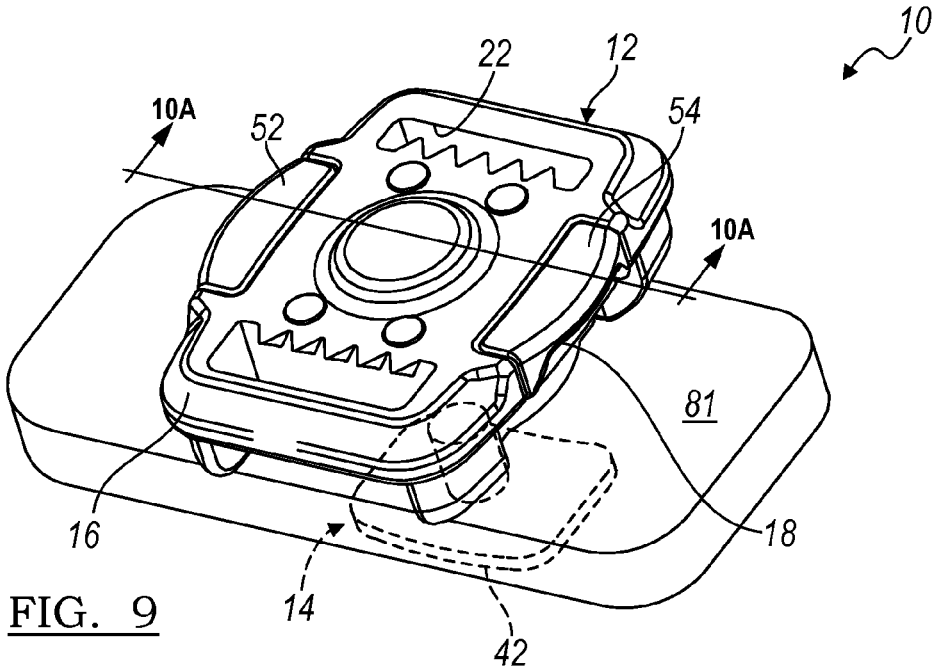
FIG. 9 is a perspective view of the locking buckle attached to the locking ball assembly, wherein locking ball assembly is attached to a piece of sports equipment in accordance with the present invention.

FIG. 9 is a perspective view of latching device 10 attached to a member 81. Member 81 is for instance a portion of a football helmet. The retention nut 42 of locking ball assembly 14 fixes the locking ball assembly 14 to the helmet. As will be described in more detail hereafter strap latching device 10 provides a means to releasably secure a strap or belt to the helmet.

Figure 10A:
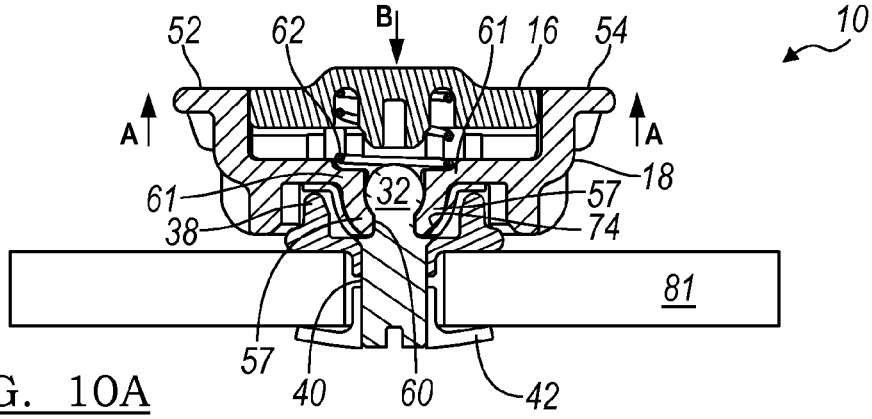
FIG. 10A is a cross-sectional view of the locking buckle in an engaged position with the locking ball assembly, wherein locking ball assembly is attached to a piece of sports equipment in accordance with the present invention.

FIG. 10A is a cross-sectional view through strap latching device 10 at the location indicated in FIG. 9. Moreover, FIG. 10A depicts the strap latching device 10 in the locked or engaged state. In the locked state, the locking ball 32 has entered the collet 56 and is captured by the collect fingers 57 which return to a non-flexed state. Engagement of the locking buckle 12 with the locking ball assembly 14 occurs when the locking buckle 12 is pressed down onto the locking ball 32. When the main body 16 is pressed downward onto the locking ball 32, the release mechanism 18 is displaced allowing the collet to move away from the second open end 80 of cavity 74 and receive the locking ball. The collet fingers 57 are then allowed to flex outward and bend at their living hinges 58 increasing the opening of the collet 56 to allow the locking ball 32 to slip past the reaction surfaces 60 of the collet fingers 57 and to be captured by the collet 56. After the collet 56 receives the locking ball 32, the spring 62 forces the collet 56 and locking ball 32 back into the cavity 74 returning the collet fingers 57 to their non-flexed state. The locking ball 32 is resistant to removal from the collet 56 until a first force (shown as arrow A) is exerted on the wing portions 52, 54 and a second force (shown as arrow B) opposing the first force is exerted on the main body portion 16.

Figure 10B:
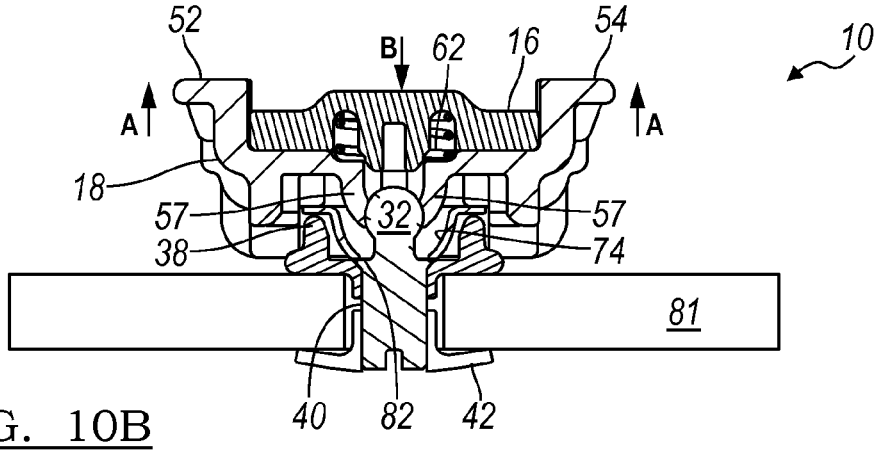
FIG. 10B is a cross-sectional view of the locking buckle being disengaged from the locking ball assembly by applying a force to the release mechanism, wherein locking ball assembly is attached to a piece of sports equipment in accordance with the present invention.

With reference to FIG. 10B, again a cross-sectional view of strap latching device 10 is illustrated. In FIG. 10B, locking ball 32 is shown moving into or out of the collet 56. During engagement or disengagement, the spring 62 is compressed and the release mechanism 18 moves away from cavity 74 and the collet fingers 57 are remote from a rim 82 of the second open end 80 and are forced outward by the locking ball 32 allowing the locking ball to slip between the collet fingers 57. After entry or exit of the locking ball 32, the collet fingers 57 spring back to their non-flexed state (shown in FIG. 10A and 100) allowing the locking ball 32 to be released or captured within the collet 56. When the locking ball 32 is contained within the collet 56, the spring 62 returns the release mechanism 18 and collet fingers 57 toward the rim 82 of the second open end 80 of the cavity 74 to the locked position (shown in FIG. 10A).

Figure 10C:
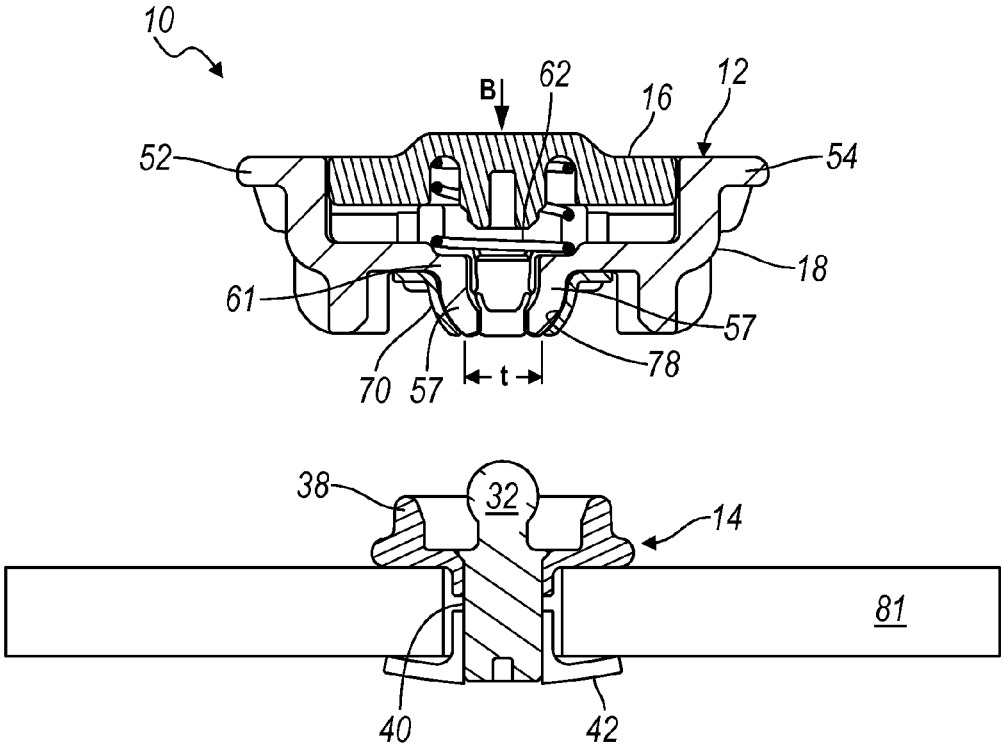
FIG. 10C is a cross-sectional view of the locking buckle disengaged from the locking ball assembly, wherein locking ball assembly is attached to a piece of sports equipment in accordance with the present invention.

With reference to FIG. 10C, again a cross-sectional view of the strap latching device 10 is illustrated in an unlocked or released state. When locking buckle 12 has been released from the locking ball assembly 14 the collet 56 and collet fingers 57 are returned to the cavity 74 of plate 70. Again, the collet fingers 57 after resiliently springing back to their non-flexed state are returned by the spring 62 to the second open end 80 of the cavity 74 and are ready to receive the locking ball 32. Moreover, the present invention contemplates that the strap latching device 10 may be calibrated to have a desired retention or extraction force necessary to remove or couple the locking buckle 12 to the locking ball assembly 14 with or without the second force (shown as arrow B). More specifically, calibration of latching device 10 is achieved by varying one of or a combination of the following: the diameter "t" of the second open end 80 in the retention plate 70, the configuration or shape of the side wall 78, size of the spring 62, the length or thickness or width "w" or shape of the collet fingers 57, the number of collet fingers 57, the size of the locking ball 32 and the configuration or thickness of the living hinge 58.

Figure 11:
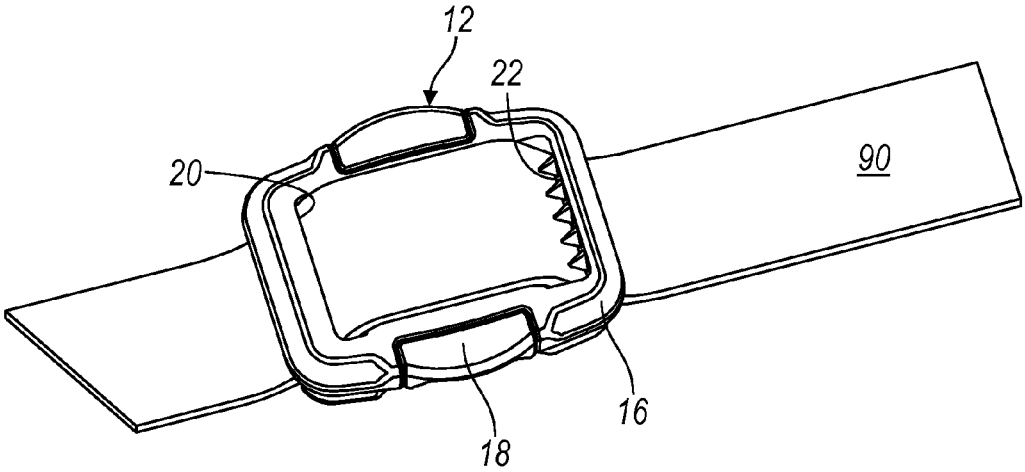
FIG. 11 is a perspective view of a strap threaded through the slots in the locking buckle in accordance with the present invention.

With reference to FIG. 11, the strap 90 is laced or threaded through the slots 20 and 22 adjacent the plurality of retention teeth 28. The plurality of retention teeth 28 are configured to restrict or prevent the movement of the strap 90 through the slots 20 and 22. Accordingly, the locking buckle 12 is adjustable along the strap 90.

Figure 12:
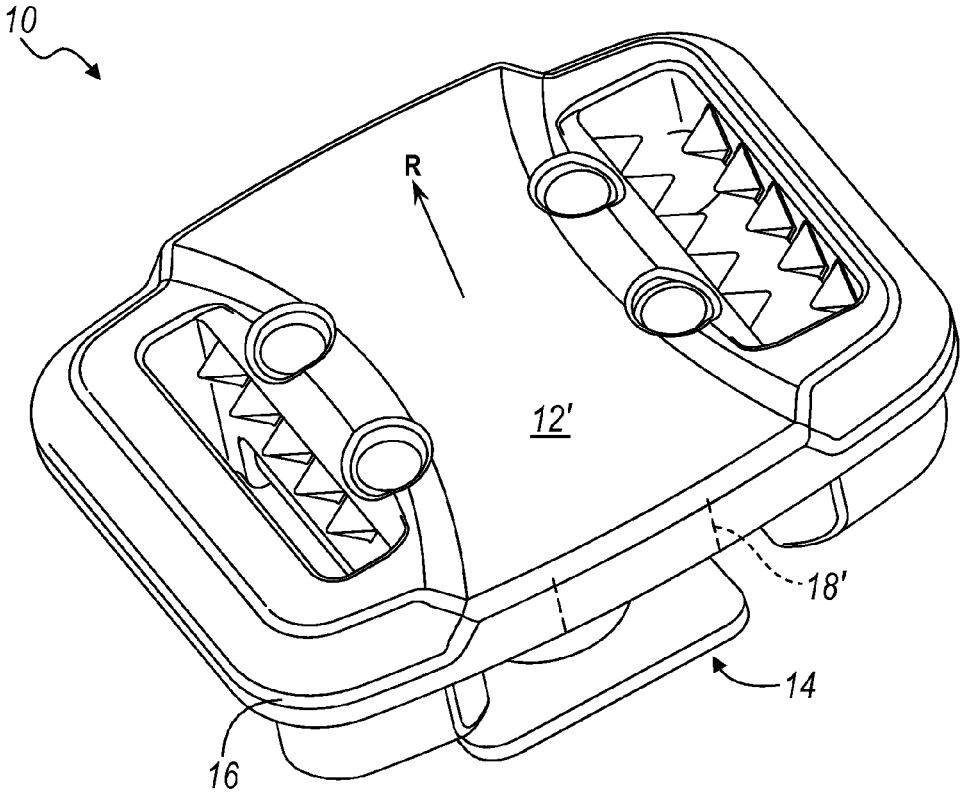
FIG. 12 is a perspective view of an alternate embodiment of a locking buckle attached to the locking ball assembly in accordance with the present invention.

FIG. 12 is a perspective view of strap latching device 10 illustrating an alternate embodiment of locking buckle 12 referenced as 12'. Locking buckle 12' includes the spring 62, chamber plate 70, and fasteners 72 as the previously described embodiment. However, the release mechanism 18 is replaced with a different release mechanism 18'. Release mechanism 18' has all the same features as release mechanism 18 with the exception of wing portions 52 and 54. More specifically, release mechanism 18' does not have wing portions 52 and 54 or any wing shaped portions. In fact, in the instant embodiment the release mechanism 18' is completely subsumed within the main body portion 16 of the buckle 12 and is configured to move within an internal hollowed out portion (not shown) of the main body portion 16. Accordingly, the main body portion of buckle 12' does not include the u-shaped channels as in the above described embodiment. In operation, the retraction of the locking ball 32 from collet 56 forces the collet fingers 57 away from second open end 80 of the cavity 74 allowing the fingers to flex or bend at their living hinges. In other words, the collet fingers 57 are not moved away from second open end 80 of the cavity 74 by applying a force "A" (shown in FIG. 10B) on the release mechanism 18' before the locking ball 32 is retracted. Instead, the collet fingers 57 are moved away from second open end 80 of the cavity 74 by applying a retraction force "R" on the main body which causes the locking ball 32 to squeeze the collet fingers 57 against the cavity 74 forcing the fingers to move outward and upward along the curved wall of the cavity. Accordingly, the size and shape of the cavity 74, the size of the spring 62 and the length or thickness or width or shape of the collet fingers 57 may be altered to increase or decrease the amount of force required to decouple the buckle 12' from the locking ball assembly 14. Thus, the present invention contemplates that buckle 12' may be calibrated to have a desired extraction or retention force necessary to remove or couple the buckle 12' to the locking ball assembly 14.

Figure 13:
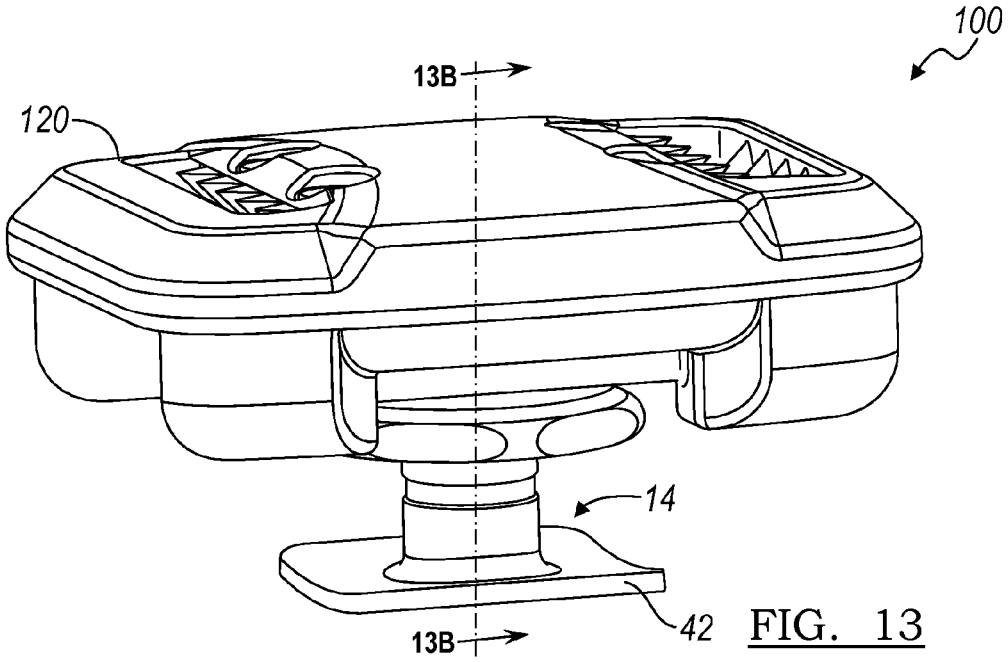
FIG. 13 is a perspective view of another alternate embodiment of a locking buckle attached to the locking ball assembly in accordance with the present invention.
Figure 13A:
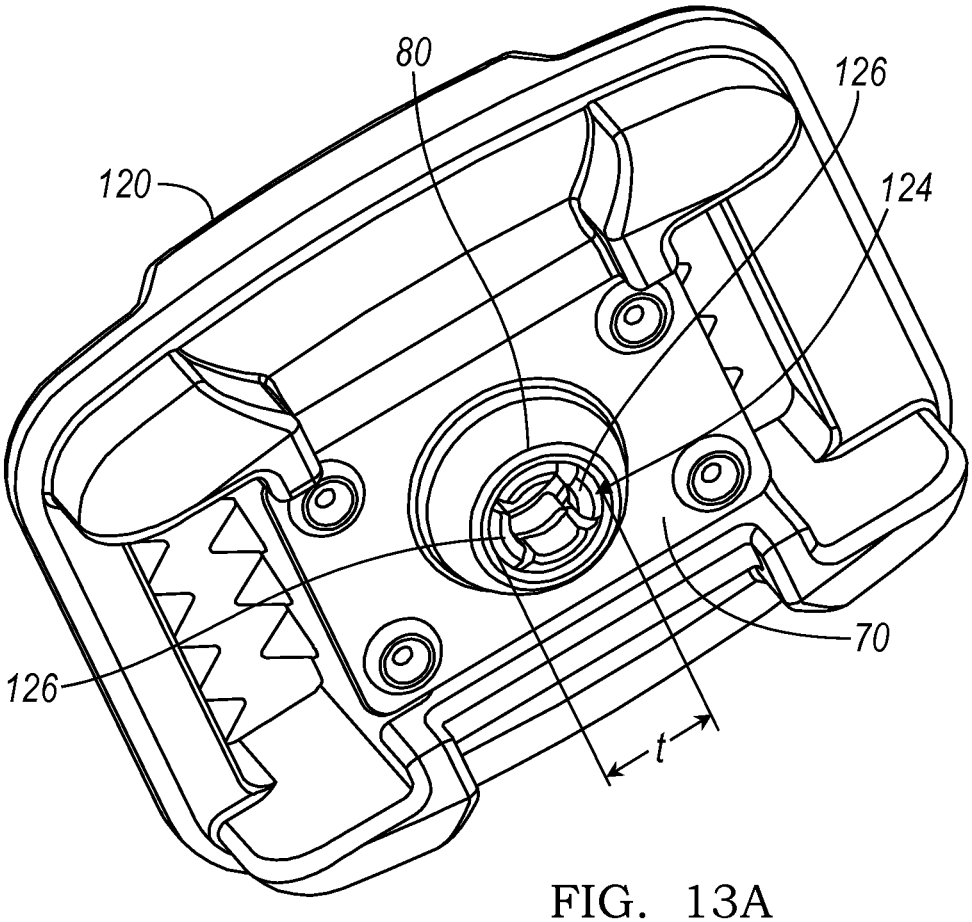
FIG. 13A is a bottom view of the alternate embodiment of the locking buckle illustrated in FIG. 13 in accordance with the present invention.
Figure 13B:
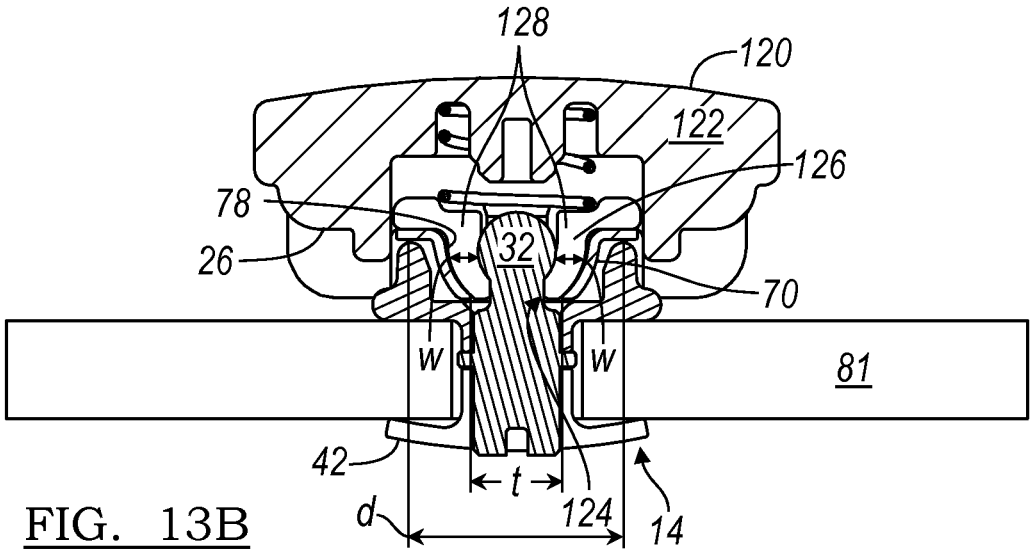
FIG. 13B is a cross-sectional view of the alternate embodiment of the locking buckle illustrated in FIGS. 13 and 13A in accordance with the present invention.

Referring now to FIGS. 13, 13A and 13B, yet another embodiment of the strap latching device 10 is illustrated and referenced as 100. Latching device 100 includes the same locking ball assembly 14 as previously described. However, buckle 12 is replaced by a buckle 120. Unlike the previous embodiments buckle 120 has a main body portion 122 that includes an integrated collet 124. Collet 124 is formed in the main body portion 122 and has collet fingers 126 that are each attached to the main body portion via a living hinge 128. The living hinge 128 allows collet fingers 126 to flex both radially and axially. As in the previous embodiments, the retention plate 70 is fastened to the underside of the main body 122 over collet 124 by fasteners or rivets. The curved side wall 78 of the cavity 74 of retention plate 70 prevents the collet fingers 126 from excessively bending. Moreover, the present invention contemplates that the strap latching device 100 may be calibrated to have a desired retention or extraction force necessary to remove or couple the buckle 120 to the locking ball assembly 14. More specifically, calibration of latching device 100 is achieved by varying one of or a combination of the following: the diameter "t" of the opening 80 in the retention plate 70, the configuration or shape of the side wall 78 of the cavity 74, the length or thickness or width "w" or shape of the collet fingers 126, the number of collet fingers 126, the size of the locking ball 32 and the configuration or thickness of the living hinge 128.

Figure 14:
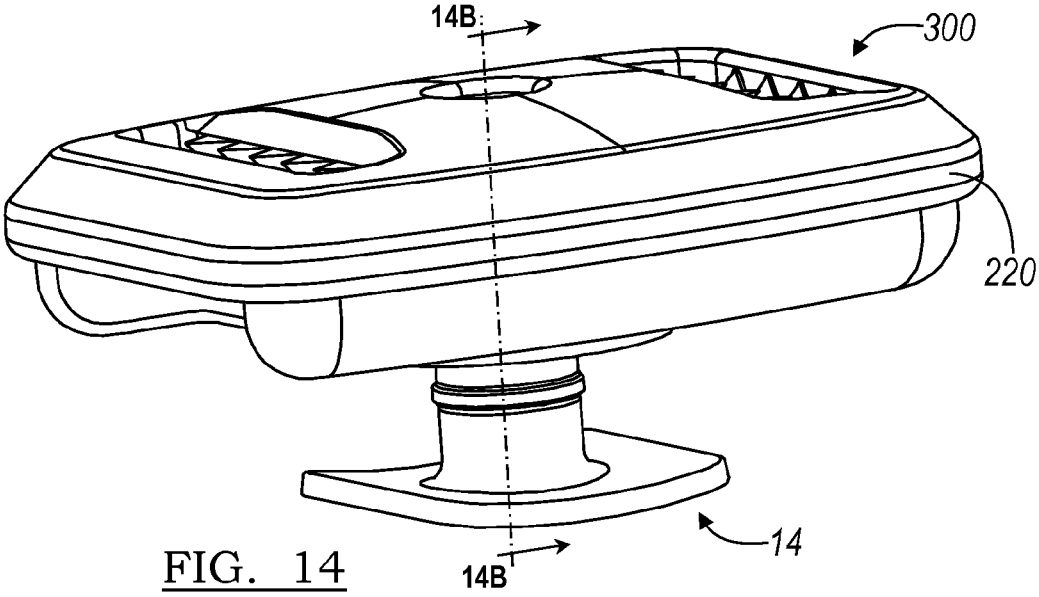
FIG. 14 is a perspective view of yet another alternate embodiment of a locking buckle attached to the locking ball assembly in accordance with the present invention.
Figure 14A:
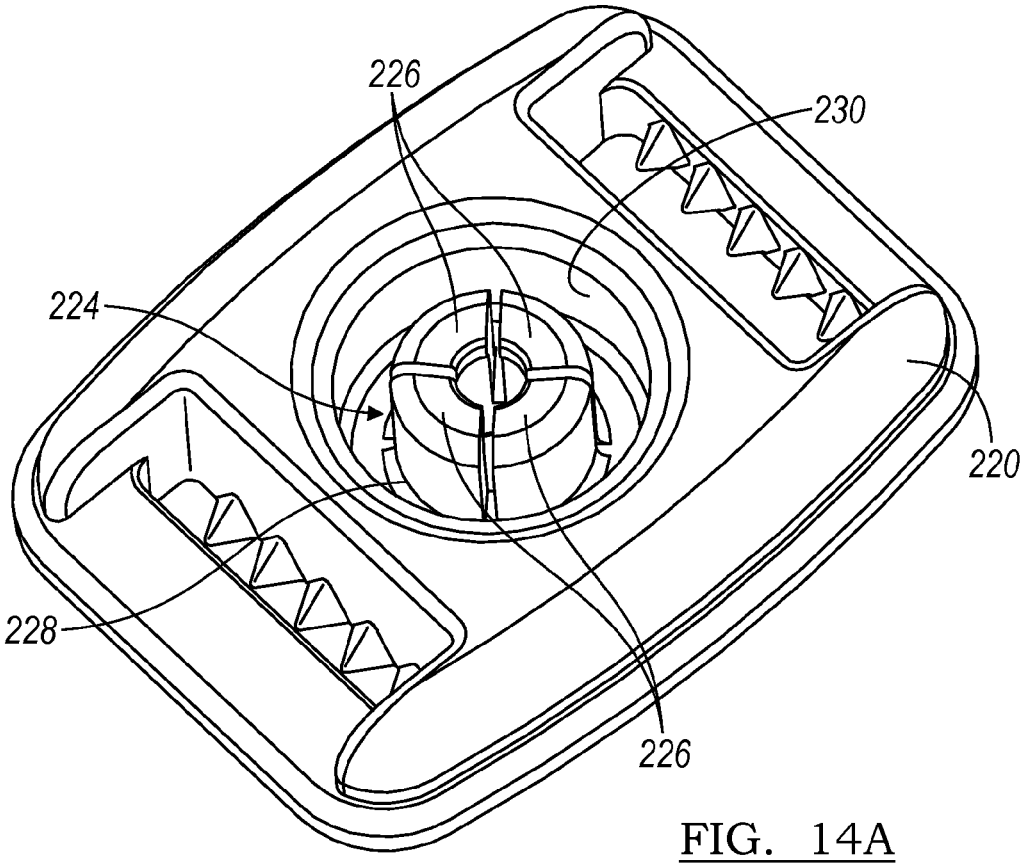
FIG. 14A is a bottom view of the alternate embodiment of the locking buckle illustrated in FIG. 14 in accordance with the present invention.
Figure 14B:
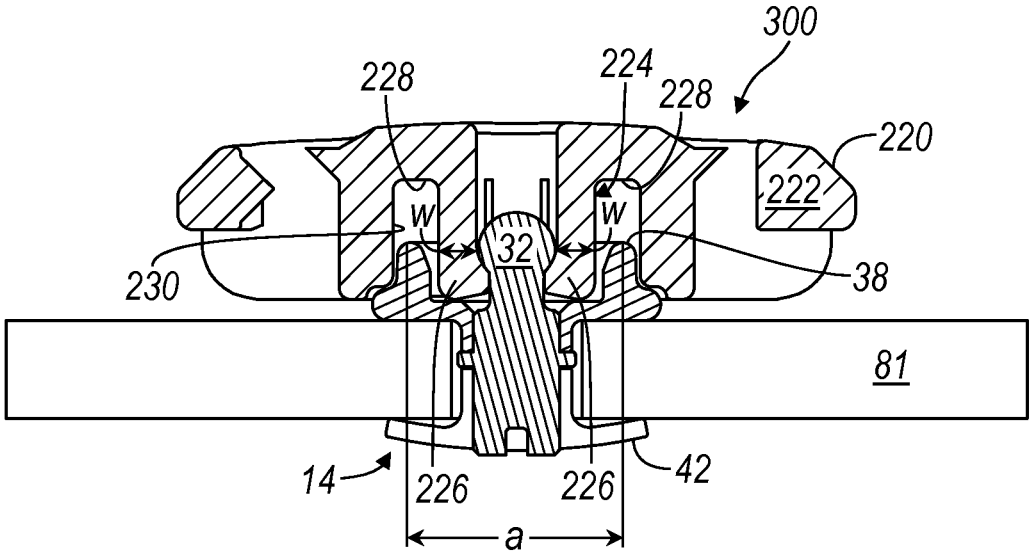
FIG. 14B is a cross-sectional view of the alternate embodiment of the locking buckle illustrated in FIGS. 14 and 14A in accordance with the present invention.

Referring now to FIGS. 14, 14A and 14B, still another embodiment of the latching device 10 is illustrated and referenced as 300. Latching device 300 includes the same locking ball assembly 14 as previously described. However, locking buckle 12 is replaced by a buckle 220. Similar to the previous embodiment buckle 220 has a main body portion 222 that includes an integrated collet 224. Collet 224 is formed in the main body portion 222 and has collet fingers 226 that are each attached to the main body portion via a living hinge 228. Living hinge 228 allows collet fingers 226 to flex both radially and axially. The present embodiment, however, does not include a retention plate 70. Instead, an annular wall 230 is formed in the main body portion 222 and is sized to cooperate with raised annular ring 38 to align the locking ball assembly 14 with buckle 220. Annular wall 230 prevents the collet fingers 226 from excessively bending or pivoting. Moreover, the present invention contemplates that the latching device 300 may be calibrated to have a desired retention or extraction force necessary to remove or couple the buckle 220 to the locking ball assembly 14. More specifically, calibration of latching device 300 is achieved by varying one of or a combination of the following: the diameter "a" of the annular ring 38, the length or thickness or width "w" or shape of the collet fingers 226, the size of the locking ball 32 and the configuration and/or thickness of the living hinge 228 may be varied or changed to provide a buckle 220 that requires more or less force to couple or extract the buckle 220 from the locking ball assembly 14.

The description of the invention is merely exemplary in nature and variations that do not depart from the gist of the invention are intended to be within the scope of the invention. For example, alternatively the present invention contemplates that the pair of rectangular slots 20 and 22 are incorporated in the release mechanism 18. More specifically, rectangular slots 20 and 22 may be incorporated in the wing portions 52 and 54 of the release mechanism 18. Accordingly, the locking buckle 12 may be disengaged from the locking ball assembly 14 by pulling on a strap 90 threaded through the slots 20 and 22. Such variations are not to be regarded as a departure from the spirit and scope of the invention.

The invention claimed is:

1. A latching device for securing a strap to a piece of sports equipment, the latching device comprising:

a buckle having a main body portion having an integrally formed collet, wherein the main body portion has a first slot and a second slot, wherein the first and second slots each having a plurality of teeth shaped members that are configured to secure the strap to the buckle;

a retention member fixedly secured to the main body portion, wherein the retention member has a collet cavity, wherein the collet is disposed in the collet cavity; and a base attached to the piece of sports equipment wherein the base has a first shaft and an annular ring, wherein the first shaft has a first end and a second end, and wherein a ball shaped member is attached to the first end of the first shaft, and wherein the annular ring is formed on a periphery of the base surrounding the first shaft, and wherein the ball shaped member is releasably received in the collet to releasably engage the buckle with the base.

2. The latching device of claim 1, wherein the collet cavity has a first open end and a second open end and a bowl shaped interior surface extending between the first and second open ends.

3. The latching device of claim 1, wherein the base has a first surface and a second surface, wherein the second end of the first shaft is fixed to the first surface of the base.

4. The latching device of claim 3, wherein the first shaft has a threaded end in threaded engagement with a threaded aperture in the first surface of the base.

5. The latching device of claim 3, further comprising a second threaded shaft extending from the second surface of the base, wherein the second threaded shaft is disposed through an aperture in the piece of sports equipment and a threaded fastener engages the threaded shaft to secure the base to the piece of sports equipment.

6. The latching device of claim 1, wherein the collet has four collet fingers wherein each of the collet fingers have a first end attached to the main body portion and a second end that is configured to engage the ball shaped member.

7. The latching device of claim 6, wherein each of the four collet fingers have a chamfered surface that engages the ball shaped member of the base.

8. The latching device of claim 6, wherein the first end of each of the collet fingers are attached to the base by a living hinge made of a polymeric material.

9. A latching device for securing a strap to a piece of sports equipment, the latching device comprising:

a buckle having a main body portion, a collet member having a collet and a retention member fixedly secured to the main body portion, wherein the retention member has a collet cavity, the collet cavity has a first open end and a second open end and wherein the collet member is moveably disposed between the main body portion and the retention member;

a biasing member disposed between the main body portion and the collet member, wherein the biasing member provides a biasing force to urge the collet member away from the main body portion and force the collet into the first open end of the collet cavity; and a locking ball assembly attached to the piece of sports equipment wherein the locking ball assembly has a first threaded shaft having a first end and a second end, wherein a ball shaped member is formed on a first end of the threaded shaft and the second end has a threaded portion, a base first surface and a second surface, wherein the first surface has a threaded aperture receiving the threaded portion of the first threaded shaft and a annular ring formed on a periphery of the base and a second threaded shaft extending from the second surface of the base, and wherein the ball shaped member is releasably received in the second open end of the collet cavity and the collet to releasably engage the buckle with the locking ball assembly.

10. The latching device of claim 9, wherein the main body portion has a u-shaped channel for receiving the collet member.

11. The latching device of claim 10, wherein the main body portion has a first slot and a second slot, wherein the first and second slots each having a plurality of teeth that extend into the slots.

12. The latching device of claim 11, wherein the main body portion has a recessed portion centered on the main body portion and a post disposed in the recessed portion, wherein the biasing member has a first end disposed on the post in the recessed portion.

13. The latching device of claim 12, wherein the collet member has a first end and a second end each having a flange extending therefrom.

14. The latching device of claim 12, wherein the collet member has a recessed portion concentric with the collet, and wherein the biasing member has a second end disposed in the recessed portion of the collet member.

15. The latching device of claim 9, wherein the collet has four collet fingers wherein each of the collet fingers have a first end attached to the collet member and a second end that is configured to engage the ball shaped member.

16. The latching device of claim 15, wherein the four collet fingers each have a chamfered surface that engage the ball shaped member of the locking ball assembly.

17. The latching device of claim 15, wherein the first end of each of the collet fingers are attached to the collet member by a living hinge made of a polymeric material.

18. The latching device of claim 9, wherein the retention member has a plurality of shaft members attached to the retention member at a first end and attached to the main body portion at a second end.

19. A latching device for securing a strap to a piece of sports equipment, the latching device comprising:

a buckle having a main body portion having a collet, wherein the main body portion has a first slot and a second slot, wherein the first and second slots each having a plurality of teeth shaped members that are configured to secure the strap to the buckle, and wherein the collet has a plurality of collet fingers wherein each of the collet fingers have a first end attached to the main body portion and a second end;

a base;

a shaft extending from the base, wherein the shaft has a first end and a second end attached to the piece of sports equipment; and a ball shaped member attached to the first end of the shaft, and wherein the second end of the each of the collet fingers are configured to engage the ball shaped member to releasably engage the buckle with the base.

* * * * *